US007537475B2

(12) United States Patent
Wise et al.

(10) Patent No.: US 7,537,475 B2
(45) Date of Patent: May 26, 2009

(54) ELECTRICAL CONNECTOR

(75) Inventors: David Wise, Dearborn, MI (US); Brent Hall, Grand Blanc, MI (US); Timothy Parkinson, Canton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 364 days.

(21) Appl. No.: 11/538,522

(22) Filed: Oct. 4, 2006

(65) Prior Publication Data

US 2008/0085621 A1 Apr. 10, 2008

(51) Int. Cl.
*H01R 13/52* (2006.01)

(52) U.S. Cl. ..... 439/276; 439/936

(58) Field of Classification Search ..... 439/205, 439/271, 276, 587, 936
See application file for complete search history.

(56) References Cited

U.S. PATENT DOCUMENTS 3,599,169 A 8/1971 Detch
4,258,076 A 3/1981 Watanabe
4,324,449 A 4/1982 Watanabe
5,562,477 A 10/1996 Moore
6,641,417 B2 * 11/2003 Tanaka et al. ..... 439/205
6,875,037 B2 4/2005 Collin
2007/0066134 A1 * 3/2007 Burris et al. ..... 439/578

FOREIGN PATENT DOCUMENTS

DE 4209846 A1 9/1993

* cited by examiner

*Primary Examiner*—Ross N Gushi

(57) ABSTRACT

An electrical connector having a cup-like first dielectric housing with electrical contacts retained by a base portion of the housing is disclosed. The electrical contacts are disposed in a region spaced from a sidewall portion. An adhesive filled capsule is disposed in the region. A second dielectric housing is configured for insertion into the cup-like first dielectric housing and having second electrical contacts retained by the second housing configured for mating with the first electrical contacts. The second dielectric housing has a sidewall with a frontal portion disposed in the region for engaging and rupturing the capsule when the second dielectric housing is inserted within the first dielectric housing to release adhesive from the adhesive filled capsule into the cup-like, first dielectric housing.

6 Claims, 5 Drawing Sheets

ELECTRICAL CONNECTOR

TECHNICAL FIELD

This invention relates generally to electrical connectors and more particularly to electrical connectors having reduced motion between mating portions of the connectors.

BACKGROUND

As is known in the art, electrical connectors include a pair of mating portions: one typically referred to as the female connector and the other the male connector. In some applications, such as when used in the electronic throttle body of an internal combustion engine, the relative motion between the mating connectors in the wire harness and the connector on the electronic throttle body (ETB) may result in plating at the electrical terminal/contact interface to be worn through due to vibration thus causing an increase in electrical contact resistance or loss of signal.

SUMMARY

In accordance with the present invention, an electrical connector is provided having a cup-like first housing having electrical contacts retained therein. An adhesive filled capsule is disposed in the first housing. A second housing is configured for insertion into the cup-like first housing. The second housing includes second electrical contacts retained by the second housing configured for mating with the first electrical contacts. The second housing has a member disposed for engaging and rupturing the capsule when the second housing is inserted within the first housing to release adhesive from the adhesive filled capsule into the cup-like, first housing.

In one embodiment, an electrical connector is provided having a cup-like first dielectric housing having electrical contacts retained by a base portion, such electrical contacts being disposed in a region spaced from a sidewall portion. An adhesive filled capsule is disposed in the region. A second dielectric housing is configured for insertion into the cup-like first dielectric housing and having second electrical contacts retained by the second housing configured for mating with the first electrical contacts. The second dielectric housing has a sidewall with a frontal portion disposed in the region for engaging and rupturing the capsule when the second dielectric housing is inserted within the first dielectric housing to release adhesive from the adhesive filled capsule into the cup-like, first dielectric housing.

In one embodiment, an electrical connector is provided having a first connector member comprising: a cup-like first dielectric housing having a base portion and a sidewall portion, such sidewall portion terminating at the bottom portion; and a plurality of first electrical contacts retained by the base portion, the plurality of electrical contacts being disposed in a region spaced from the sidewall portion. The electrical connector includes a capsule disposed on the base portion in the region spaced from the sidewall portion. An adhesive is disposed within the capsule. The electrical connector includes a second connector member comprising: a second dielectric housing having a sidewall configured for insertion into the cup-like first dielectric housing, such sidewall having a frontal portion in registration with the region spaced from the sidewall portion of the first dielectric housing when the second dielectric housing is inserted within the first dielectric housing, and a plurality of second electrical contacts configured for mating with the first electrical contacts to provide electrical connection between the first electrical contacts and the second electrical contacts, such electrical contacts being retained by the second dielectric housing within the sidewall of the second dielectric housing. The frontal portion of the sidewall of the second dielectric housing engages and ruptures the capsule when the second dielectric housing is inserted within the first dielectric housing releasing the adhesive from the capsule into the cup-like, first dielectric housing.

In accordance with another feature of the invention, a method includes providing cup-like first housing having electrical contacts retained by a base portion; disposing an adhesive filled capsule in the first housing; inserting a second housing insertion into the cup-like first housing, such second electrical contacts being retained by the second housing and configured for mating with the first electrical contacts, such second housing having a member disposed for engaging and rupturing the capsule when the second housing is inserted within the first housing to release adhesive from the adhesive filled capsule into the cup-like, first housing; and engaging and rupturing the capsule with the member when the second housing is inserted within the first housing to release adhesive from the adhesive filled capsule into the cup-like, first housing.

The capsule keeps the glue fresh and prevents the glue from being exposed to air and drying. When the connector halves are joined, the capsule is punctured allowing the glue to spread evenly and dry. Typical problems avoided with the capsule application method are: old/stale glue; glue fumes and other environmental and health issues; extra equipment needed to deal with these issues such as, expensive application equipment and maintenance (machines typically must be cleaned after every shift), glue drying prematurely and potentially damaging application equipment and parts, and the mess. Typical glue application methods are messy, and manufacturing engineers just don't like to deal with them. Glue ends up on the floor, on clothes, on hands, everywhere. Additionally, the capsule method applies glue with no additional labor/processes/steps. The process of assembling the 2 connector halves (which is done anyway) also releases and applies the glue.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Figure 1A:
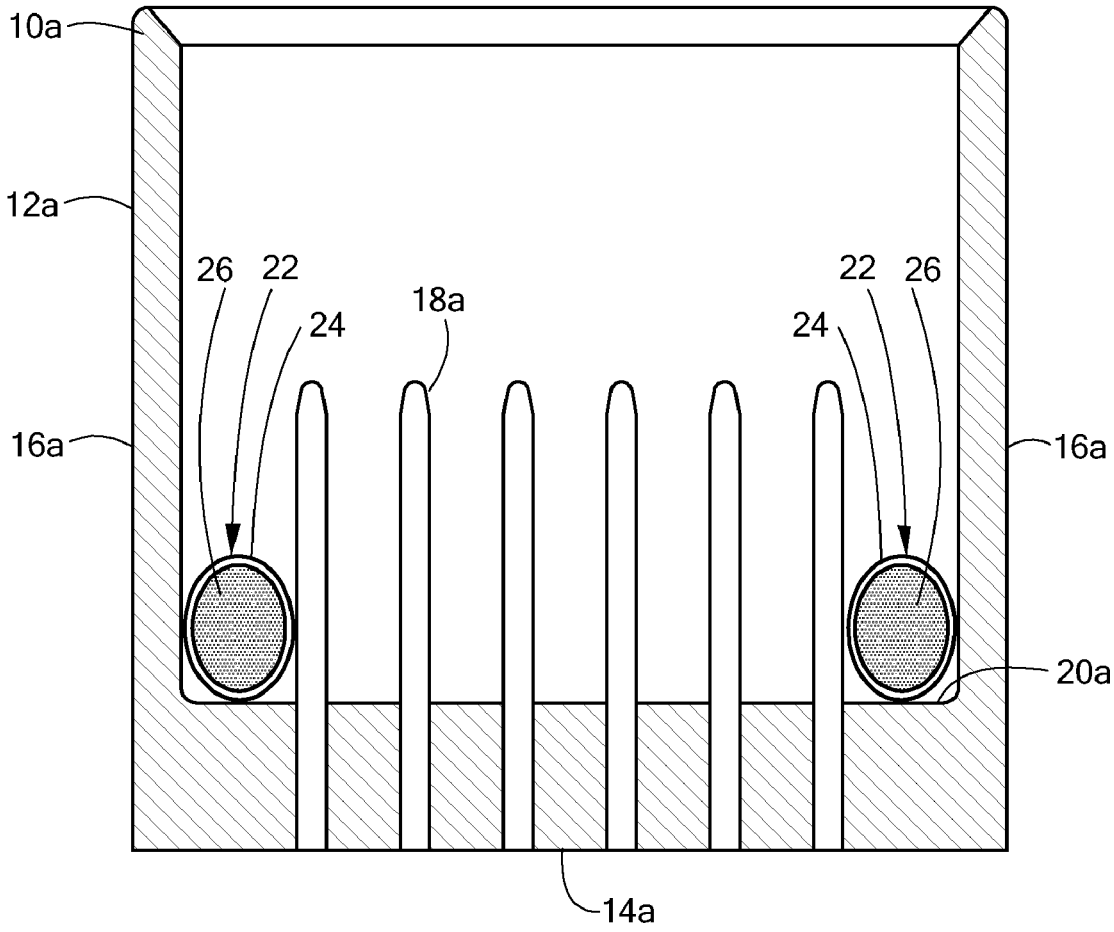
FIG. 1A is an isometric view of a first housing of an electrical connector according to the invention.
Figure 1B:
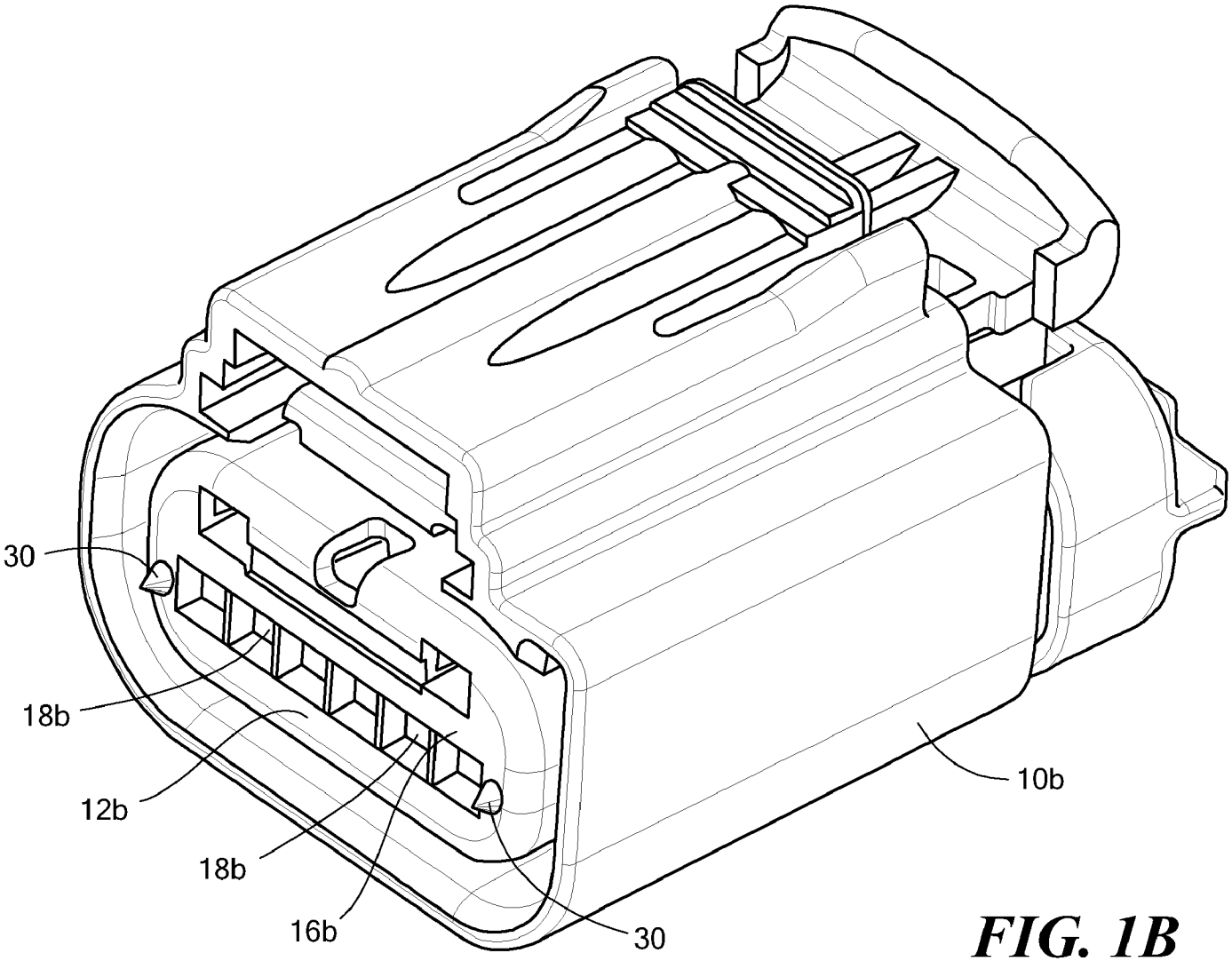
FIG. 1B is a side elevation, cross-sectional view of a second housing of the connector, insertion of the second housing into the first housing providing the connector according to the invention.

Referring now to FIGS. 1A and 1B, a pair of matable connector members 10*a*, 10*b*, respectively, for an electrical connector is shown. The first connector member 10*a* includes: a cup-like first dielectric housing 12*a* having a base portion 14*a* and a sidewall portion 16*a*, such sidewall portion 16*a* terminating at the bottom portion 14*a*, and a plurality of first electrical contacts 18*a* retained by the sidewall 16*a* and the base portion 14*a*. The plurality of electrical contacts 18*a* is disposed in a region 20*a*, here a pair of regions 20*a*, spaced from the sidewall portion 14*a*. A capsule 22, here a pair of capsules, is disposed on the base portion 14*a* in the region 20*a* spaced from the sidewall portion 16*a*. The capsule 22 has, here for example, a plastic housing 24. An adhesive 26 is disposed within the capsule 22.

The second connector member 10*b* includes a second dielectric housing 12*b* having a sidewall 16*b* configured for insertion into the cup-like first dielectric housing 12*a*. The sidewall 16*b* has a frontal portion 30 in registration with the regions 20*a* spaced from the sidewall portion 14*a* of the first dielectric housing 12*a* when the second dielectric housing 12*b* is inserted within the first dielectric housing 12*a*. The second connector member 10*b* also includes a plurality of second electrical contacts 18*b* configured for mating with the first electrical contacts 18*a* to provide electrical connection between the first electrical contacts and the second electrical contacts 18*a*, 18*b*. The electrical contacts 18*b* are retained by the second dielectric housing 12*b* within the sidewall 12*b* of the second dielectric housing. The frontal portion 30 of the sidewall 14*b* of the second dielectric housing 12*b* engages and ruptures the housing 24 of the capsule 22 when the second dielectric housing 12*b* is inserted within the first dielectric housing 12*a* releasing the adhesive 26 from the capsule 22 into the cup-like, first dielectric housing 10*a*.

Here, the capsules 22 are disposed on the sidewall 12*a* and the base portion 20*a* of the first dielectric member 10*a*. Here, the first electrical contacts 18*a* are pins and the second electrical contacts 18*b* are sleeves to receive the pins 18*a*.

Figure 2A:
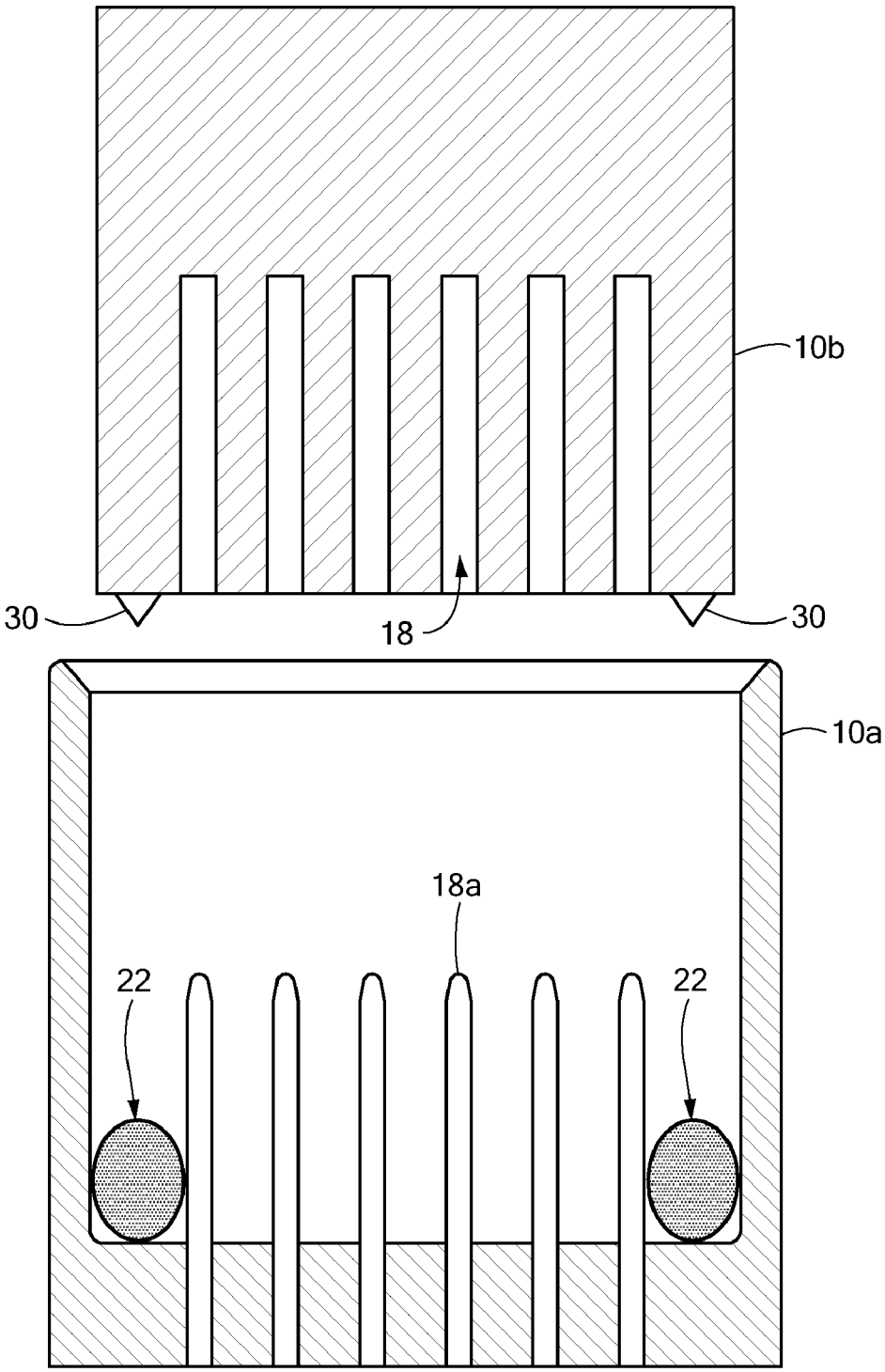
FIG. 2A is a side view of the first and second housings of FIG. 1A and 1B prior to engagement.
Figure 2B:
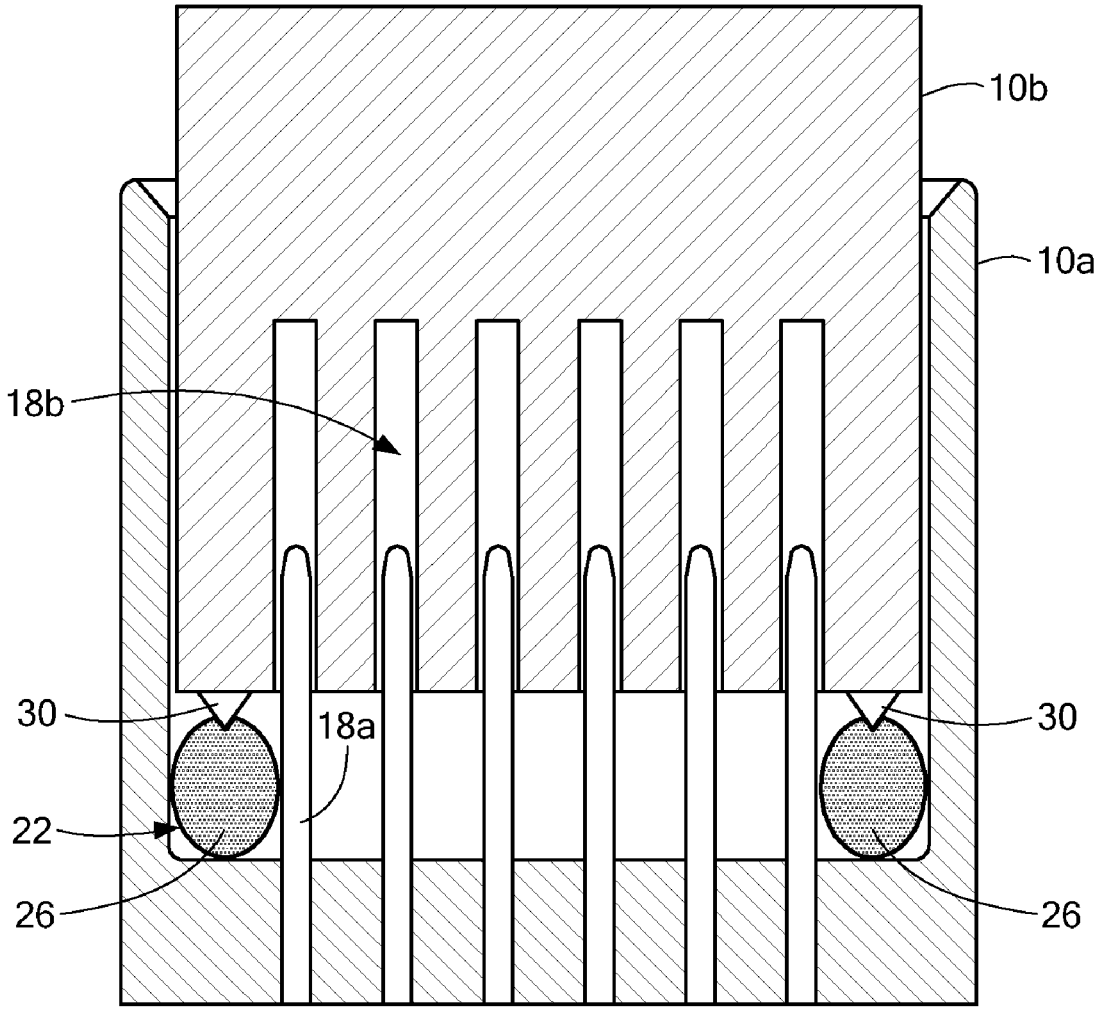
FIG. 2B is a side view of the first and second housings of FIG. 1A and 1B partially engaged.
Figure 2C:
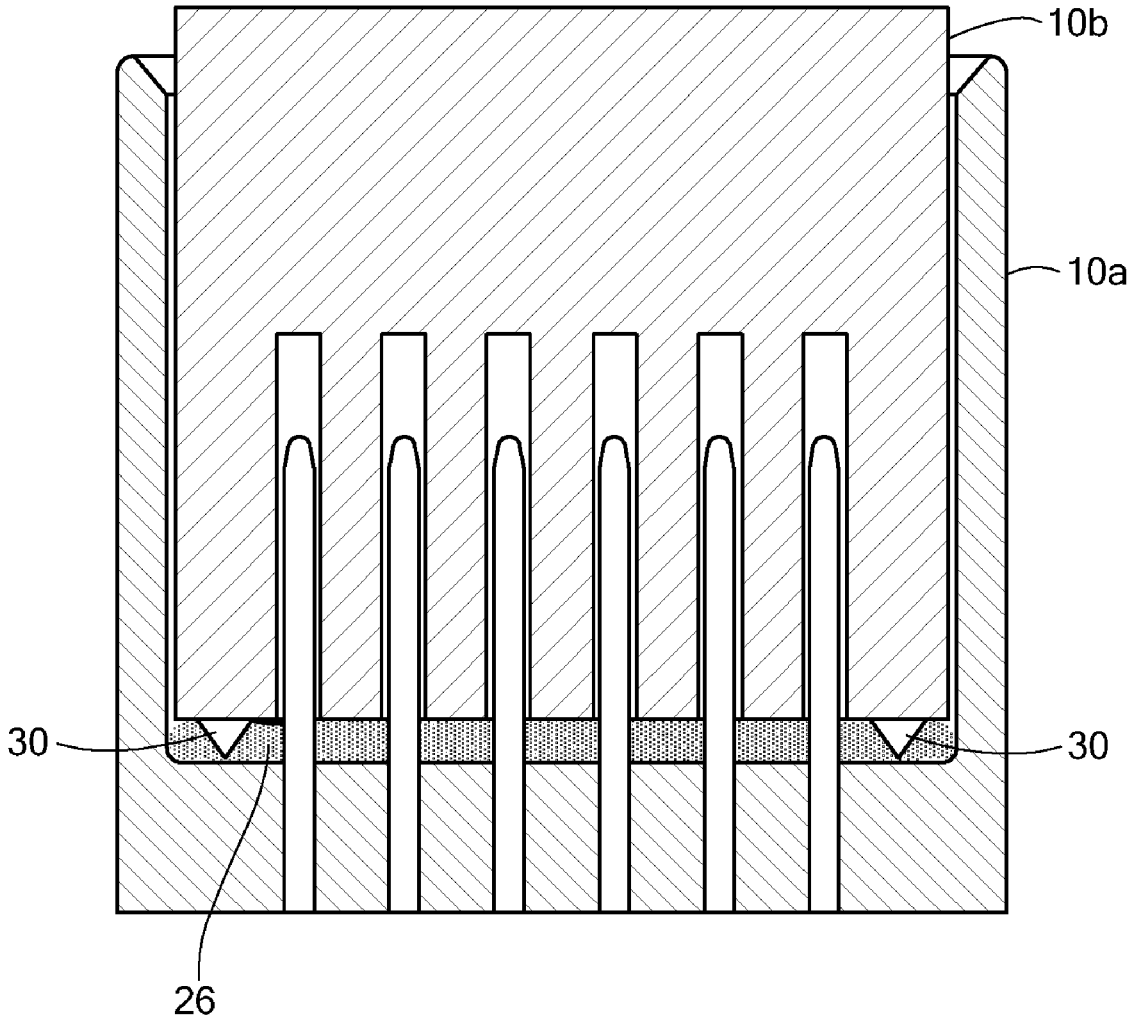
FIG. 2C is a side view of the first and second housings of FIGS. 1A and 1B fully engaged.

The pair of matable member 10*a*, 10*b* is attached as follows: Referring also top FIGS. 2A, 2B and 2C, the first member 10*a* providing the cup-like first housing 12*a* having electrical contacts 18*a* retained by the base portion 14*a*. Next, the adhesive filled capsule 22 is disposed within the first housing 12*a*. Next, the second housing 12*b* is inserted into the cup-like first housing 12*a* with the second electrical contacts 18*b* mating with the first electrical contacts 18*a*. As the members 10*a*, 10*b* are mated, the frontal portion 30 of the first housing engages and ruptures the housing 24 of the capsule 22 when the second housing 12*b* is inserted within the first housing 12*a* to thereby release the adhesive 26 from the adhesive filled capsule 22 into the cup-like, first housing 12*a*.

A number of embodiments of the invention have been described. Nevertheless, it will be understood that various modifications may be made without departing from the spirit and scope of the invention. Accordingly, other embodiments are within the scope of the following claims.

What is claimed is:

1. An electrical connector, comprising:

(A) a first connector member comprising:

a cup-like first dielectric housing having a base portion and a sidewall portion, such sidewall portion terminating at the bottom portion;

a plurality of inwardly facing male electrical contacts retained by the base portion, the plurality of male electrical contacts being disposed in a region spaced from the sidewall portion;

(B) a capsule disposed on the base portion in the region spaced from the sidewall portion, such capsule being disposed between the sidewall portion and a surface portion of one of the male contacts;

(C) an adhesive disposed within the capsule;

(D) a second connector member comprising:

a second dielectric housing having a sidewall configured for insertion into the cup-like first dielectric housing, such sidewall having a frontal portion in registration with the region spaced from the sidewall portion of the first dielectric housing when the second dielectric housing is inserted within the first dielectric housing;

a plurality of female electrical contacts configured for mating with the male electrical contacts to provide electrical connection between the male electrical contacts and the female electrical contacts, such female electrical contacts being retained by the second dielectric housing within the sidewall of the second dielectric housing; and (E) wherein the frontal portion of the sidewall of the second dielectric housing engages and ruptures the capsule when the second dielectric housing is inserted within the first dielectric housing releasing the adhesive from the capsule into to the cup-like, first dielectric housing.

2. The electrical connector recited in claim 1 wherein the frontal portion of the sidewall of the second dielectric housing has a pointed member disposed for engaging and rupturing the capsule when the second dielectric housing is inserted within the first dielectric housing to release adhesive from the adhesive filled capsule into the cup-like, first dielectric housing.

3. The electrical connector recited in claim 1 wherein the capsule is disposed on the sidewall and the base portion of the first dielectric member.

4. The electrical connector recited in claim 3 wherein the male electrical contacts are pins and the female electrical contacts are sleeves to receive the pins.

5. A method, comprising:

providing a cup-like first dielectric housing having a plurality of male electrical contacts retained by a base, the plurality of male electrical contacts being disposed in a region spaced from the sidewall portion;

disposing an adhesive filled capsule in the first dielectric housing, on the base portion in the region spaced from the sidewall portion between the sidewall portion and a surface portion of one of the male contacts; and inserting a second dielectric housing having a plurality of female electrical contacts into the cup-like first dielectric housing, said second dielectric housing having a sidewall configured for insertion into the cup-like first dielectric housing, such sidewall of the second dielectric housing having a frontal portion in registration with the region spaced from the sidewall portion of the first dielectric housing when the second dielectric housing is inserted within the first dielectric housing, such female electrical contacts being retained by the second dielectric housing and configured for mating with the male electrical contacts, such second housing having a member disposed for engaging and rupturing the capsule when the second dielectric housing is inserted within the first dielectric housing to release adhesive from the adhesive filled capsule into the cup-like, first dielectric housing.

6. The method of claim 5, further comprising:

engaging and rupturing the capsule when the second dielectric housing is inserted within the first dielectric housing to release adhesive from the adhesive filled capsule into the cup-like, first dielectric housing.

* * * * *